US009677806B2

(12) United States Patent
Bischofberger et al.

(10) Patent No.: US 9,677,806 B2
(45) Date of Patent: Jun. 13, 2017

(54) REFRIGERATION DEVICE WITH A VEGETABLE DRAWER

(75) Inventors: Thomas Bischofberger, Kiβlegg (DE); Hans Ihle, Giengen (DE); Astrid Klingshirn, Zusmarshausen (DE)

(73) Assignee: BSH Hausgeräte GmbH, Munich (DE)

( * ) Notice: Subject to any disclaimer, the term of this patent is extended or adjusted under 35 U.S.C. 154(b) by 770 days.

(21) Appl. No.: 13/390,690

(22) PCT Filed: Aug. 23, 2010

(86) PCT No.: PCT/EP2010/062224
§ 371 (c)(1),
(2), (4) Date: Feb. 16, 2012

(87) PCT Pub. No.: WO2011/026749
PCT Pub. Date: Mar. 10, 2011

(65) Prior Publication Data

US 2012/0146477 A1 Jun. 14, 2012

(30) Foreign Application Priority Data

Sep. 2, 2009 (DE) ..... 10 2009 029 139

(51) Int. Cl.
*F25D 25/02* (2006.01)

(52) U.S. Cl.
CPC .. *F25D 25/025* (2013.01); *F25D 2317/04131* (2013.01); *F25D 2500/02* (2013.01)

(58) Field of Classification Search
CPC ..... F25D 25/025; F25D 2500/02; F25D 2317/04131
USPC ..... 312/236, 349, 350, 270.1, 402, 404, 312/270.3, 291, 296, 311; 62/408, 441, 62/407, 382, 440, 419, 302; 220/908
See application file for complete search history.

(56) References Cited

U.S. PATENT DOCUMENTS

| | | | | |
|---|---|---|---|---|
| 2,846,286 | A * | 8/1958 | Gomersall | 312/270.3 |
| 3,108,455 | A * | 10/1963 | Hanson | 62/382 |
| 4,250,719 | A * | 2/1981 | Grimm et al. | 62/382 |
| 4,732,435 | A * | 3/1988 | Bailey et al. | 312/311 |
| 4,850,206 | A * | 7/1989 | Larsen | 62/382 |
| 5,193,892 | A | 3/1993 | Swindell | |
| 5,632,399 | A * | 5/1997 | Palmieri et al. | 220/253 |

(Continued)

FOREIGN PATENT DOCUMENTS

| | | |
|---|---|---|
| CN | 1714264 A | 12/2005 |
| CN | 1888789 A | 1/2007 |

(Continued)

OTHER PUBLICATIONS

International Search Report PCT/EP2010/062224.

(Continued)

*Primary Examiner* — Daniel J Troy
*Assistant Examiner* — Hiwot Tefera
(74) *Attorney, Agent, or Firm* — Nixon & Vanderhye P.C.

(57) ABSTRACT

A refrigeration device includes a housing which surrounds a storage compartment; and a container mounted in the storage compartment and including a drawer and a cover, with the cover being height-adjustable between a closed position of the drawer and an open position. The cover is guided on an obliquely sloping path between the closed position and the open position by ramps adjacent to corners of the cover.

26 Claims, 2 Drawing Sheets

(56) References Cited

U.S. PATENT DOCUMENTS

| | | | | |
|---|---|---|---|---|
| 5,641,217 | A * | 6/1997 | Caruso et al. | 312/404 |
| 5,918,480 | A * | 7/1999 | Nagata et al. | 62/440 |
| 5,947,573 | A | 9/1999 | Tovar et al. | |
| 6,460,555 | B1 * | 10/2002 | Tuller et al. | 134/200 |
| 6,834,922 | B2 * | 12/2004 | Cho | 312/331 |
| 7,363,773 | B2 * | 4/2008 | Lee et al. | 62/408 |
| 7,624,593 | B2 * | 12/2009 | Lee et al. | 62/408 |
| 8,015,839 | B2 * | 9/2011 | Kang et al. | 62/408 |
| 8,201,570 | B2 * | 6/2012 | Froelicher | 134/200 |
| 2002/0181197 | A1 * | 12/2002 | Huang | 361/685 |
| 2005/0145704 | A1 | 7/2005 | Hwang | |
| 2005/0172657 | A1 * | 8/2005 | Hwang | 62/407 |
| 2006/0005567 | A1 | 1/2006 | Lee et al. | |
| 2006/0061247 | A1 | 3/2006 | Lee et al. | |
| 2007/0262686 | A1 | 11/2007 | Ji | |
| 2008/0035189 | A1 * | 2/2008 | Gunnerson et al. | 134/56 D |
| 2008/0196440 | A1 | 8/2008 | Kang et al. | |

FOREIGN PATENT DOCUMENTS

| | | | |
|---|---|---|---|
| CN | 101071033 | A | 11/2007 |
| GB | 693733 | | 7/1953 |
| KR | 20020051135 | A | 6/2002 |
| RU | 2290577 | | 12/2006 |
| WO | 2005064248 | A1 | 7/2005 |

OTHER PUBLICATIONS

Report of Examination DE 10 2009 029 139.3.
Decision on Granting issued in corresponding Russian Application No. 2012112039/13 dated Jun. 2, 2014.
Nov. 18, 2015 First Office Action issued in Chinese Application No. 201410229012.1 (translation only).

* cited by examiner

REFRIGERATION DEVICE WITH A VEGETABLE DRAWER

BACKGROUND OF THE INVENTION

The present invention relates to a refrigeration device, in particular a domestic refrigeration device, having a housing which surrounds a storage compartment and a container which can be mounted in said storage compartment. If such a container is kept closed, a more humid microclimate can be maintained therein than in the surrounding storage compartment, the air of which during operation of the refrigeration device is constantly dehumidified in contact with a cold evaporator surface. The humid microclimate in the container is particularly suited to the storage of groceries, which continuously evaporate water and on account of said evaporation forfeit the quality in particular of fresh vegetables, fruit and suchlike. Such a container is therefore generally also referred to as vegetable drawer or vegetable box.

Since different groceries require different levels of humidity in order to maintain their freshness to an optimum degree, it may be necessary as a function of the type of groceries accommodated in the container to conduct humidity out of the container to a greater or lesser degree. A moveable seal which is attached in a front face or a cover of the container is usually used here to control the release of humidity from the container, said seal, in an open position, allowing the escape of humid air out of the container into the surrounding storage compartment. This known solution is however less effective so that particularly when refrigerated products with a high level of transpiration are accommodated in the container, water condenses out on a cold wall of the container and can collect at the bottom of the container. This risk is in particular made even greater by the fact that the coldest wall of the container is generally the rear wall and, since it is the furthest removed from the seal, the highest air humidity values are reached there. If the refrigerated product is in contact with the condensed water, its storage stability is seriously affected.

Documents WO 2004/038312 A1, CN 1 888 789 A and WO 2005/064248 A1 disclose refrigeration devices with a housing which surrounds a storage compartment and a container which can be mounted in the storage compartment and comprises a drawer and a cover, whereby the cover can be height-adjusted between a closed position of the drawer and an open position.

KR 2002 0051135 A describes a container for a refrigeration device, which comprises a cover which is pivotably attached to the container so that it can be adjusted between a closed position of the container and an open position.

U.S. Pat. No. 4,250,719 A discloses a refrigeration device having a housing which surrounds a storage compartment and includes a drawer and a cover. The cover can be height-adjusted between a closed position of the drawer and an open position. The cover is guided on an obliquely sloping path between the closed position and the open position.

US 2007/262686 A1 shows a refrigeration device having a housing which surrounds a storage compartment and a container mounted in the storage compartment which includes a drawer and a cover, whereby the cover can be height-adjusted between a closed position of the drawer and an open position.

BRIEF SUMMARY OF THE INVENTION

The object of the invention is therefore to specify a refrigeration device with a storage compartment and a container accommodated in the storage compartment, whereby a more effective control of the humidity in the container is possible than with conventional devices.

Refrigeration device is in particular understood to mean a domestic refrigeration device, in other words a refrigeration device which is used for homemaking, like for instance a refrigerator or a fridge-freezer combination. The refrigeration device can be a no-frost refrigeration device, in which in order to cool its storage compartment, cold air is blown into the storage compartment from an evaporator chamber.

The object is achieved by, in the case of a refrigeration device having a housing which surrounds a storage compartment and a container which can be mounted in said storage compartment, comprising a drawer and a cover, the cover being height-adjustable between a closed position of the drawer and an open position. The height adjustment of the cover enables a gap to be produced over the entire periphery of the container or at least over a large part thereof. There are therefore considerably fewer regions inside the container which are far removed from a ventilation passage and are accordingly only poorly aeratable, and from which humidity can only be inadequately conducted. While with a conventional container refrigerated products contained therein can form a barrier which cuts off a rear region of the container from an air exchange via an air passage disposed in the front region of the container, the inventive construction significantly reduces the probability that a region inside the container interior is cut off from an air exchange by means of the refrigerated product container therein. Furthermore with an otherwise suitable design of the refrigeration device, raising the cover enables the formation of a transverse air flow through the open container, which effects a very fast and effective air exchange with the surrounding storage compartment.

In order to be able to control the intensity of the air exchange with the storage compartment, the cover should be stable in at least one, preferably each intermediate position between the closed position and the open position.

A particularly simple guiding mechanism and also a self-locking of the cover in the open position and/or in the intermediate positions can be realized, if the cover is guided on an obliquely declining path between the open position and the closed position.

In order to guide the cover in a stable fashion on this path, ramps adjacent to the corners of the cover are preferably used. Such a ramp may be part of the cover which is moveable therewith or fixed to the housing of the refrigeration device. The ramp can for instance adopt the form of an oblique flank of a hook or an oblique edge of a slot.

To ensure that the cover is not blocked by refrigerated products placed thereupon or hindered in terms of its movement, it is expediently arranged tightly below a horizontal wall which extends thereacross. This wall may be a ceiling of the housing, the horizontal wall is preferably a plate inserted in the storage compartment, which can for its part be used as a refrigerated product carrier.

If the cover is suspended from the plate, a refrigeration device housing which is known per se can be used in order to create an inventive refrigeration device by the plate with the suspended cover being inserted therein. This on the one hand enables a cost-effective manufacture of the inventive refrigeration device by largely using already existing components; there is on the other hand also the option of equipping an existing refrigeration device in accordance with the invention by installing a plate with the suspended cover.

To adjust the cover vertically, provision is preferably made for a horizontally moveably guided slider, and of the cover and slider one comprises an oblique guiding contour and the other an element which interacts with the guiding contour and can be displaced relative to said guiding contour.

In order to be easily accessible to a user, the slider is preferably attached to a front edge of the horizontal wall.

The guiding contour can run obliquely in a vertical plane transversely to the direction of motion of the slider, it preferably runs obliquely in a horizontal plate, in other words, it extends both in the width and also in the depth of the refrigeration device housing. The displaceable element and the guiding contour are then to be moveable opposite one another in the vertical.

The path of an air flow which can be powered by a ventilator or by means of convection, preferably passes above the cover at least in the closed position of the cover. The container is particularly intensively cooled in the closed position on its top side, which counteracts an unwanted temperature difference from top to bottom in the container. When the cover is open, the same air flow can pass between this and the drawer, through the container in order to provide for an efficient air exchange with the storage compartment and a dehumidification of the container interior.

To ensure rapid and user-friendly access to the contents of the container, the drawer can preferably be removed from the refrigeration device housing independently of the cover.

In order to reliably seal the container on the one hand in the closed position of the cover, but on the other hand prevent the removal of the drawer, it is expedient if a contact surface of the drawer, on which the cover rests in its closed position, slopes downwards toward a rear wall of the housing.

BRIEF DESCRIPTION OF THE DRAWINGS

Further features and advantages of the invention result from the subsequent description of exemplary embodiments with reference to the appended figures, in which.

DETAILED DESCRIPTION OF EXEMPLARY EMBODIMENTS OF THE PRESENT INVENTION

Figure 1:
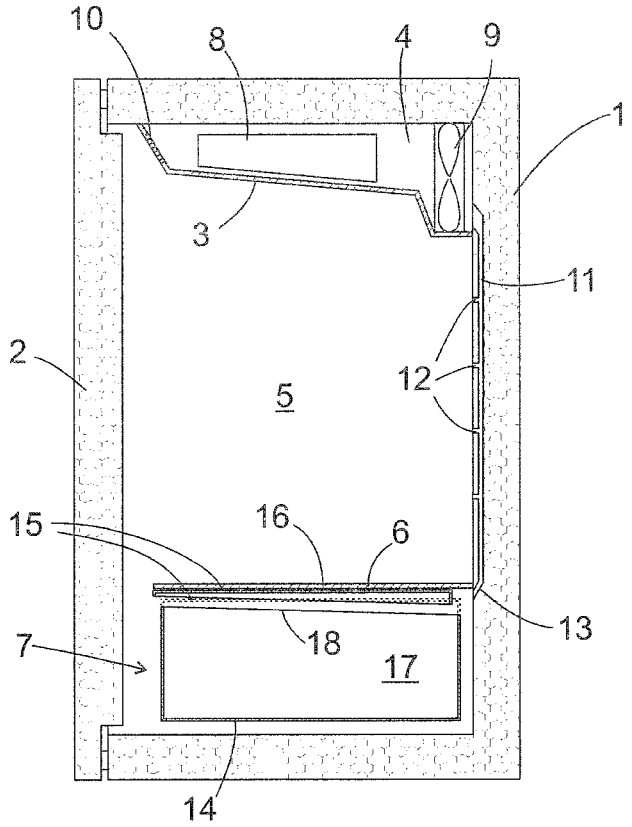
FIG. 1 shows a schematic cross-section through an inventive refrigeration device according to a first embodiment of the invention.

FIG. 1 shows a schematic cross-section through a no-frost domestic refrigeration device having a carcass 1 and a door 2, which surround an interior. The interior is divided into an evaporator chamber 4 and a storage compartment 5 for refrigerated products by means of a drawer 3 mounted below the ceiling of the carcass. The storage compartment 5 is split by means of a horizontal plate 6, which can be embodied in particular as a glass plate in order to form a compartment for a container 7 near to the base, which is in particular embodied as a pull-out box.

An evaporator 8 and a ventilator 9 are accommodated in the evaporator chamber 4 in a manner known per se. If the ventilator 9 is in operation, it takes air into the evaporator chamber 4 from the storage compartment 5 via openings on a front edge of the drawer 3 where it cools down in contact with the evaporator 8 and pushes the cooled air into a distributor line 11, which runs downwards in a rear wall of the carcass 1. Several outlet ports 12 of the distributor line 11 open at different heights into the storage compartment 5; a lowest outlet port 13 opens into the compartment of the container 7 below the plate 6.

The container 7 includes a drawer 14 which is injection molded from plastic, can be removed from the carcass 1 on telescopic rails (not shown) and is shown in FIG. 1 in a position inserted into the carcass 1 up to a stop and includes a cover 15, which, in a closed position shown in FIG. 1 as a dashed contour, completely covers an open topside of the essentially square drawer 14 in its stop position. A flow channel 16 extends in the extension of the distributor 11 connected to its outlet port 13 between the cover 15 and the plate 6. A flow channel which is parallel to the channel 16 can extend along the rear wall and below the base of the drawer 14, the container 7 is in each case predominantly cooled by the air flow in the channel 16.

The drawer 14 has side walls 17 with upper edges 18 which slope down slightly toward the rear wall of the carcass 1 and bottom edges of the cover 15 which rest on these upper edges 18 in the closed position slope in a complimentary fashion with respect to the upper edges 18. When the drawer 14 is removed from the storage compartment 5, the cover 15 stays behind. As a result of the downwards slope of the edges 18, contact with the cover 15 is lost here after a brief movement of the drawer 14, so that this does not prevent further forward movement of the drawer 14.

The cover 15 is continuously adjustable between the closed position and an open position shown with a continuous line. While the cover 15 in the closed position keeps the cold air from the outlet port 13 away from the inside of the container 7, it largely blocks the flow channel 16 in the open position and the air escaping from the outlet port 13 must flow between the cover 15 and drawer through the inside of the container 7. A slight lifting of the cover 15 is therefore already sufficient to produce an effective air exchange between the inside of the container 7 and the surrounding storage compartment 5.

Figure 2:
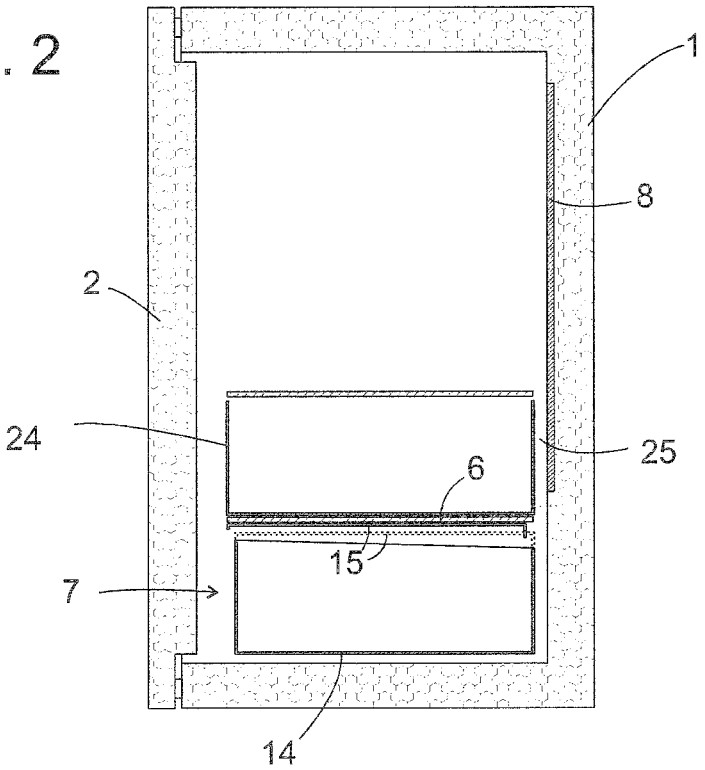
FIG. 2 shows a schematic section similar to FIG. 1 in accordance with a second embodiment.

A guiding mechanism for the adjustment of the cover 15 is described below with reference to FIGS. 3 and 4, since the same mechanism is also used in a second embodiment of the refrigeration device, which is shown in FIG. 2 in a section similar to FIG. 1.

The refrigeration device in FIG. 2 is a coldwall device having an evaporator 8 arranged in a rear wall of the carcass 1. The container 7 is described in the same way as with reference to FIG. 1. A second pull-out box 24 which is attached above the container 7 and its plate 6 holding the cover 15 overlaps with the evaporator 8 in the vertical so that a gap 25 between the pull-out box 24 and the rear wall is intensively cooled. Cold air flowing downwards in the gap 25 flows through the flow channel 16 between the cover 15 and the plate 6 holding the same or through the container 7 depending on the position of the cover 15.

Figure 3:
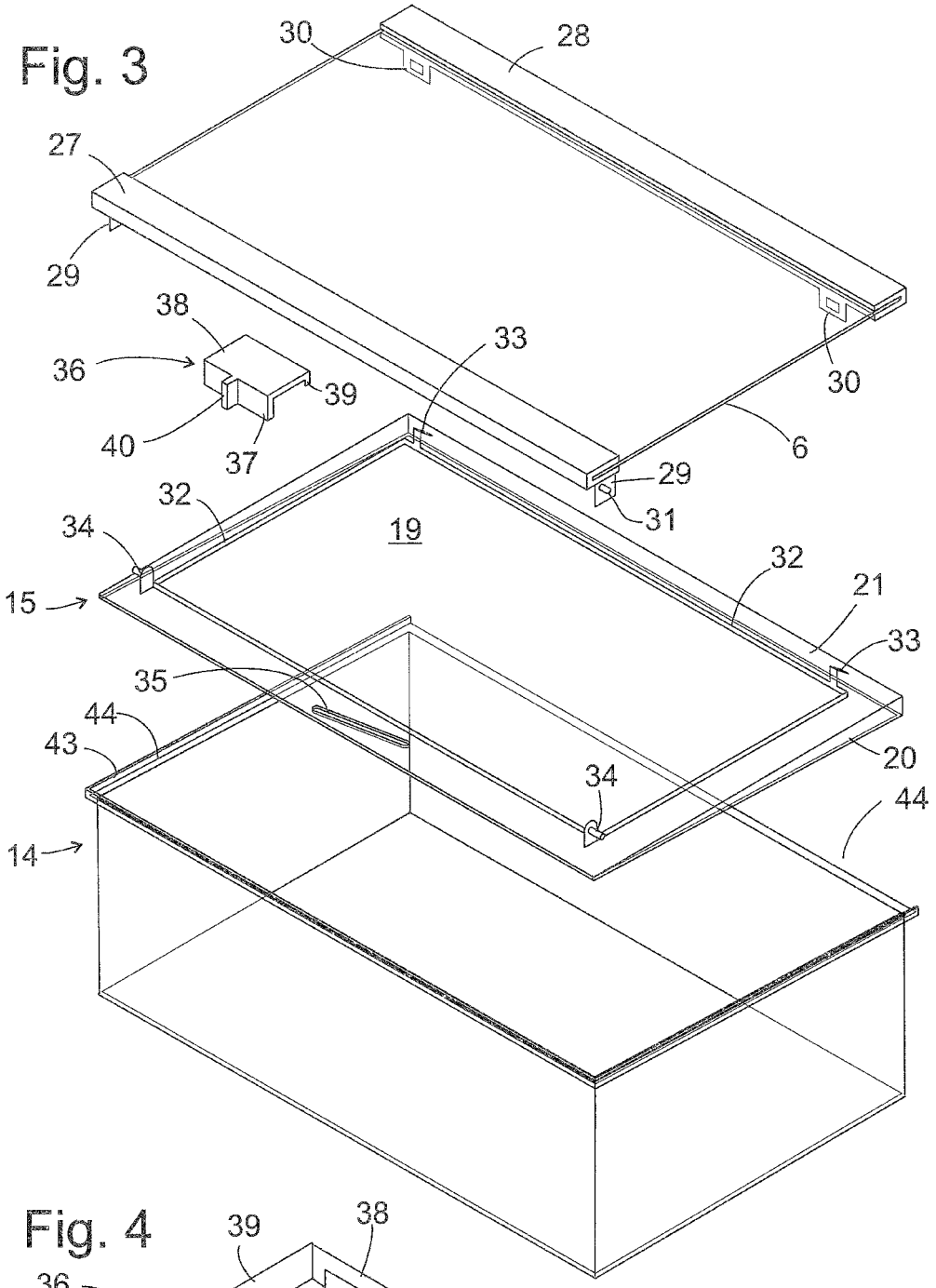
FIG. 3 shows an exploded view of a container having a drawer and cover for integration in a refrigeration device according to FIG. 1 or 2 and a plate of the refrigeration device, from which the cover of the container is suspended.
Figure 4:
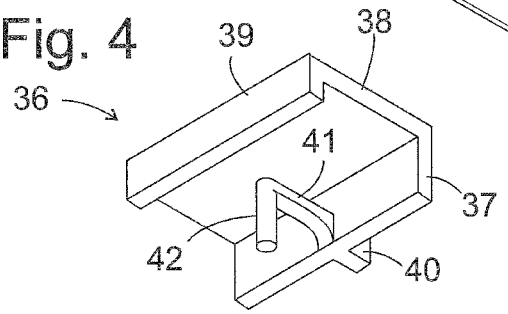
FIG. 4 shows an enlarged perspective view of a slider, which is used to adjust the distance between the drawer and cover of the container in FIG. 3

FIG. 3 shows a detailed view of a plate 6, a cover 15 and a drawer 14, which can be used in the refrigeration devices shown in FIGS. 1 and 2.

The plate 6 made of safety glass is enclosed on its front and rear edge in two profiles 27, 28 made of plastic or metal, in particular aluminum. Tabs 29 and/or 30 which reach downwards onto the profiles 27, 28 are attached adjacent to the corners of the plate 6 in each instance. The tabs 29 of the front profile each comprise a slot 31 which is directed obliquely downwards.

The cover 15 essentially includes flat or slightly arched rectangular plates 19 made of plastic for reinforcement, on the edges of which vertical walls 20, 21 are molded. The walls 20, 21 rest in the closed position on the upper edges of the drawer 14 and extend this to form the overall square pull-out boxes 7. Ribs 32 forming a rectangular frame and protruding upwards are molded on the upper side of the plate 19. A rib 32 adjacent to the rear edge of the plate 19 supports two hooks, the free end of which is formed in each instance by a tongue 33 which slopes obliquely downwards. In the assembled state, the tongues 33 extend in each instance through an opening in the rear tabs 30. Pins 34 protrude laterally from the ribs 32 in each instance adjacent to the front corners of the cover 15. These pins 32 engage in the oblique slots 31 of the front tabs 32 in the assembled state. A guiding contour in the form of an oblique slot 35 running in the depth and width direction of the carcass 1 extends on the front edge of the cover 15.

A slider 36 which can be locked on the front profile 27 and is moveable in its longitudinal direction is shown in an oblique perspective view from below in FIG. 4. The slider 36 includes three wall elements 37, 38, 39 which are connected at right angles and made in one piece and are similar to an asymmetrical U-profile, which, in the assembled state, enclose the profile on its front, upper and rear sides. An operating segment 40, on which the slider 36 can be easily gripped for sliding purposes, protrudes forwards from the wall element 37. A finger 41 is molded to an opposite side of the wall element 37, said finger extending in the assembled state below the lower side of the profile 27 in parallel to the wall element 38. An end segment 42 of the finger 41 which is angled downwards is provided, in order, in the assembled state, to engage in the slot 35 of the cover 15. The length of this end segment corresponds at least to the vertical freedom of movement of the cover 15 which is defined by the vertical extension of slots 31 and tongues 33. The engagement of the end segment 41 into the slot 35 delimits the freedom of movement of the slider 36 along the profile 27 and it forces a movement of the cover 15 which is coupled to the sideways movement of the slider 36 in the depth direction of the carcass 1. The engagement of the pins 34 and tongues 33 into the tabs 39, 30 in turn restricts the freedom of movement of the cover 15 on a path which is inclined obliquely forwards so that a movement of the cover 15 in the depth direction is inevitably associated with a movement in the vertical.

In other words, if the slider 36 is in a stop position in which the finger 41 strikes the left end of the slot 35, the cover 15 is in a position which closes the pull-out box 7, in which it rests completely on a horizontal stop surface 44 on the upper edge of the walls of the drawer 14 and tightly closes the drawer 14. The stop surface 44 is surrounded here on three sides by a frame 43 in order to clearly define the position of the cover 15. The frame 43 is open at a rear of the drawer 14, so that the drawer 14 can be pulled out from the refrigeration device without taking the cover 15 with it even if this is in the closed position. The pins 34 are found in each instance on the lower, rear end of the slot 31 and the tongues 33 are moved through the openings of the tabs 30 over almost their entire length.

If the slider 36 is moved into an opposite stop position, in which its finger 41 is at the right end of the slot 35, the cover 15 is moved forwards and simultaneously on account of the engagement of the pin 34 and tongues 33 into the tabs 29, 30, is moved upwards. As a result, the cover 15 and drawer 14 are distanced from one another and air can flow out of outlet port 13 through the container 7.

The extension of the slot 35 in the width direction of the carcass 1 is greater than that in the depth direction. The more extreme the ratio is and/or the less the orientation of the slot 35 deviates from the width direction, the stronger its self-locking of the guiding mechanism shown, which holds the cover 15 counter to the force of gravity acting thereupon at a distance from the stop surface 44. This self-locking keeps the cover 15 stable when the slider 36 is in any position.

The invention claimed is:

1. A refrigeration device, comprising:

a housing which surrounds a storage compartment;

a cooling device adapted to provide cooling to the storage compartment; and a container mounted in the storage compartment and including a drawer and a cover, said cover being height-adjustable between a closed position and an open position while the drawer is closed, said cover being guided on an obliquely sloping path between the closed position and the open position by ramps adjacent to diagonally opposite corners of the cover.

2. The refrigeration device of claim 1, constructed in the form of a domestic refrigeration device.

3. The refrigeration device of claim 1, wherein the cover is stable in at least one intermediate position between the closed position and the open position.

4. The refrigeration device of claim 1, wherein the cover is stable in each intermediate position between the closed position and the open position.

5. The refrigeration device of claim 1, wherein the cover is arranged tightly below a horizontal wall extending thereabove.

6. The refrigeration device of claim 5, wherein the horizontal wall is a plate inserted into the storage compartment.

7. The refrigeration device of claim 6, wherein the cover is suspended from the plate.

8. The refrigeration device of claim 1, further comprising a slider guided for movement in a horizontal direction, wherein one member selected from the group consisting of the cover and the slider has an oblique guiding contour and another member of the group has an element which interacts with the guiding contour and is displaceable relative to the guiding contour.

9. The refrigeration device of claim 8, wherein the cover is arranged tightly below a horizontal wall extending thereabove, said slider being attached to a front edge of the horizontal wall.

10. The refrigeration device of claim 8, wherein the guiding contour runs obliquely in a horizontal plane.

11. The refrigeration device of claim 1, wherein a flow path passes above the cover and across a top surface of the cover at least in the closed position of the cover.

12. The refrigeration device of claim 1, wherein the drawer is removable independently of the cover.

13. The refrigeration device of claim 1, wherein the drawer has a contact surface on which the cover rests in the closed position and which slopes downwards toward a rear wall of the housing.

14. The refrigeration device of claim 11, wherein the flow path allows flow from behind a rear side of the cover to beyond a front side of the cover.

15. The refrigeration device of claim 1, wherein the ramps comprise a first ramp and a second ramp, and the first ramp comprises a slot and the second ramp comprised a tongue.

16. The refrigeration device of claim 1, wherein an adjustable gap is provided in the closed position and the adjustable gap is substantially uniform around an entire periphery of an upper surface of the drawer as the cover is adjusted.

17. The refrigeration device of claim 1, wherein the ramps are disposed on the housing.

18. A refrigeration device, comprising:

a housing that at least partially surrounds a storage compartment;

a cooling device adapted to provide cooling to the storage compartment; and a container mounted in the storage compartment and including a drawer and a cover, said cover being height-adjustable between a closed position and an open position while the drawer is closed, said cover being adjustable to provide an adjustable gap between the cover and an entire periphery of an upper surface of the drawer.

19. The refrigeration device of claim 18, wherein the cover is height-adjustable by way of a first ramp and a second ramp, and the first ramp comprises a slot and the second ramp comprised a tongue.

20. The refrigeration device of claim 18, wherein the drawer has a contact surface on which the cover rests in the closed position such that the adjustable gap is closed and which slopes downwards toward a rear wall of the housing.

21. The refrigeration device of claim 18, wherein when the cover is in the closed position, an air flow path is provided above the cover that allows air to flow across a top surface of the cover from rearward of a rear-most portion of the cover to forward of a front-most portion of the cover.

22. The refrigeration device of claim 21, wherein when the cover is in the open position, an air flow path is provided below the cover from rearward of a rear-most portion of the cover to forward of a front-most portion of the cover.

23. The refrigeration device of claim 18, wherein the cover is guided on an obliquely sloping path between the closed position and the open position by ramps adjacent to corners of the cover.

24. The refrigeration device of claim 23, wherein the ramps are adjacent to diagonally opposite corners of the cover.

25. The refrigeration device of claim 18, wherein the adjustable gap is substantially uniform around the entire periphery of the upper surface of the drawer as the cover is adjusted.

26. The refrigeration device of claim 18, wherein the ramps are disposed on the housing.

* * * * *